US006241643B1

(12) United States Patent
Loft et al.

(10) Patent No.: US 6,241,643 B1
(45) Date of Patent: Jun. 5, 2001

(54) ARM EXERCISING DEVICE

(76) Inventors: Soren A. Loft, 2208 S. Fairgreen Ave., Monrovia, CA (US) 91016; Victor Konovalov, 228 Calle Descanso, Walnut, CA (US) 91789; Richard L. Rasmussen, 1841-A Mayflower Ave., Monrovia, CA (US) 91016

( * ) Notice: Subject to any disclaimer, the term of this patent is extended or adjusted under 35 U.S.C. 154(b) by 0 days.

(21) Appl. No.: 09/047,505

(22) Filed: Mar. 25, 1998

(51) Int. Cl.[7] ..... H63B 21/012
(52) U.S. Cl. ..... 482/114; 482/44
(58) Field of Search ..... 601/33, 34; 482/111, 482/114–116, 118, 119, 44, 49, 906, 121–124, 126, 128–131, 133, 134, 110, 112, 106; 602/20, 21, 5, 12, 16

(56) References Cited

U.S. PATENT DOCUMENTS

| | | | | |
|---|---|---|---|---|
| 2,832,334 | * | 4/1958 | Whitelaw | 601/33 |
| 3,042,023 | * | 7/1962 | Yates | 601/33 |
| 4,669,450 | * | 6/1987 | Lindberg | 482/112 |
| 4,669,451 | * | 6/1987 | Blauth et al. | 601/34 |
| 4,899,735 | * | 2/1990 | Townsend et al. | 601/40 |
| 5,042,799 | * | 8/1991 | Stanley | 482/114 |
| 5,088,731 | * | 2/1992 | Carpenter | 482/114 |
| 5,176,601 | * | 1/1993 | Reynolds | 482/121 |
| 5,179,939 | * | 1/1993 | Donovan et al. | 601/33 |
| 5,333,604 | * | 8/1994 | Green et al. | 601/33 |
| 5,337,737 | * | 8/1994 | Rubin et al. | 601/33 |
| 5,470,297 | * | 11/1995 | Park | 482/130 |
| 5,662,595 | * | 9/1997 | Chesher et al. | 601/33 |
| 5,839,998 | * | 11/1998 | Wilkinson | 482/133 |
| 5,848,979 | * | 12/1998 | Bonutti et al. | 601/33 |

* cited by examiner

*Primary Examiner*—Richard J. Apley
*Assistant Examiner*—Justine R. Yu
(74) *Attorney, Agent, or Firm*—Edgar W. Averill, Jr.

(57) ABSTRACT

An arm exercising device for strengthening a user's biceps and triceps. The device has an upper arm support platform which is attached to the user's upper arm. The upper arm platform is hinged to a hand driven arm. The hand driven arm holds a handle so that the handle can slide along the hand driven arm as the exerciser pulls and pushes the hand driven arm with respect to the upper arm platform. Friction is provided at a pivot point between these two members so that the user's bicep is exercised during the pulling in of the hand driven arm and the tricep is exercised as the hand driven arm is pushed outwardly. The device can also be attached between a user's chest and an arm and used to exercise deltoid and lateral muscles.

8 Claims, 4 Drawing Sheets

ARM EXERCISING DEVICE

BACKGROUND OF THE INVENTION

The field of the invention is exercising devices and the invention relates more particularly to exercising devices for exercising a user's biceps, triceps, deltoids and laterals.

Numerous devices have been devised for arm exercising. One such device is shown in U.S. Pat. No. 5,042,799. This device utilizes a spring loaded pair of arms pivoted at the user's elbow. Resistance is created by a spring. As one exercises one's arm the spring only works the user's biceps and the device must be reconfigured to exercise a user's triceps.

U.S. Pat. No. 4,718,665 shows an exercising device which utilizes a breaking system using planetary gears. The device is designed to contact the limbs adjacent a joint and because of the positioning of collars adjacent the joint would exert substantial strain against the limbs. This is because the collars are very close to the joints.

U.S. Pat. No. 5,454,769 shows a wrist and forearm exercising apparatus which utilizes a spring and pivoted handle. It is limited to the exercising of a forearm.

SUMMARY OF THE INVENTION

It is an object of the present invention to provide a lightweight device for exercising a user's biceps, triceps, deltoid and lateral muscles.

The present invention is for an arm exercising device for strengthening a user's biceps and triceps which device can be placed in an alternative position and used to exercise a user's deltoid and lateral muscles. The device has an upper arm support platform which is attached to a user's upper arm against a user's tricep muscle. A hand driven assembly is pivotally attached to the upper arm support platform. A handle is attached to the hand driven assembly and the handle is fixed so that while the hand driven arm is being pivoted back and forth during exercise the handle will move in and out in an axial direction along the hand driven assembly. Means are provided for adjustably applying friction at the pivot hinge to allow the user to create the desired amount of resistance. The device may alternatively be used to exercise deltoid and lateral muscles. This is accomplished by strapping the hand driven against a user's side and affixing the upper arm support platform to the user's upper arm. In this way, as the user's arm is moved away from his or her body, the user's deltoid muscle is exercised and conversely, as the arm is brought back toward the body the user's lateral muscles are exercised. Preferably, the means for adjustably applying friction includes an elastomeric member within a sleeve. The elastomeric member may be compressed or adjustably released to provide more or less resistance against a sleeve at the pivot hinge.

DESCRIPTION OF THE PREFERRED EMBODIMENTS

Figure 1:
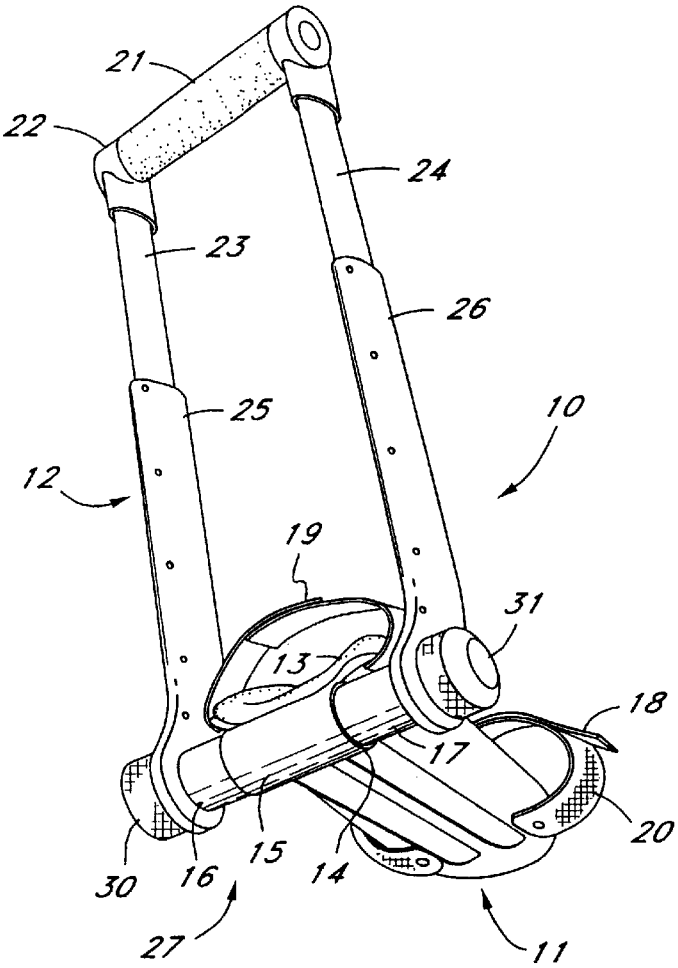
FIG. 1 is a perspective view of the arm exercising device of the present invention showing the top of an upper arm support platform and the bottom of a hand driven assembly.

The arm exercising device of the present invention is shown perspective view in FIG. 1 and indicated generally by reference character 10. The device has an upper arm support platform 11 which is pivotally attached to a hand driven assembly 12. The upper arm support platform has a pivot end 13 and the hand driven assembly 12 has a platform attaching end 14. Pivot end 13 includes a pivot sleeve 15 which is located adjacent pivot end collars 16 and 17.

Upper arm support platform 11 has a pair of straps 18 and 19 which include conventional Velcro fasteners 20.

Figure 2:
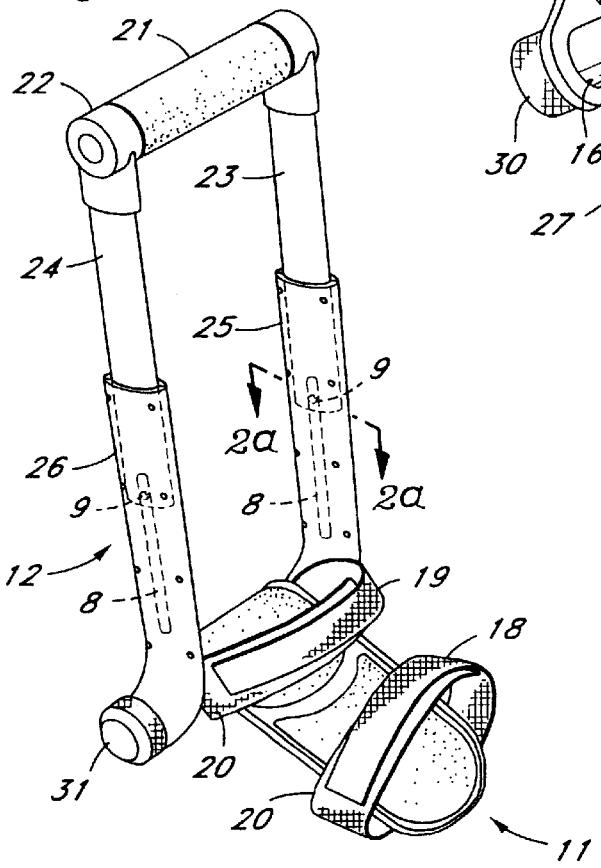
FIG. 2 is a perspective view of FIG. 1 showing the top of the platform and the top of the hand driven assembly thereof.
Figure 2A:
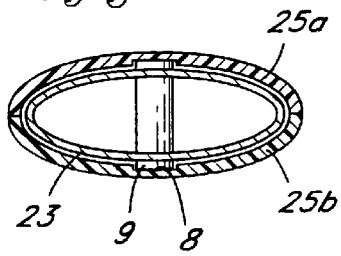
FIG. 2*a* is a cross-sectional view taken along line 2*a*—2*a* of FIG. 2.
Figure 3:
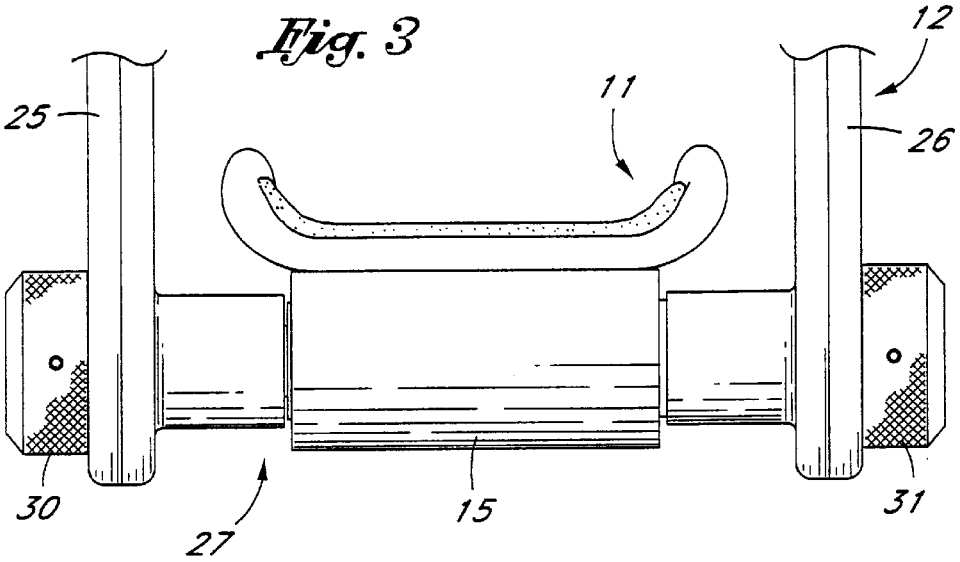
FIG. 3 is an enlarged end view of the upper arm support platform of the arm exercising device of FIG. 1 and showing the bottom of the pivot end of the hand driven assembly thereof.

The hand driven assembly 12 has a handle 21 at a hand grasping end 22 thereof. The handle is attached to the ends of piston rods 23 and 24 which slide in and out along elliptical tube assemblies 25 and 26. Piston rods 23 and 24 are preferably elliptical to provide maximum strength in the direction of the commonly applied forces. The handle 21 preferably is constructed as a foam covered sleeve which can freely rotate over a shaft not shown. As shown in FIG. 2*a*, a roll pin 9 rides in a pair of grooves 8 in elliptical tube assemblies 25 and 26 which limits the travel of the handle.

Figure 4:
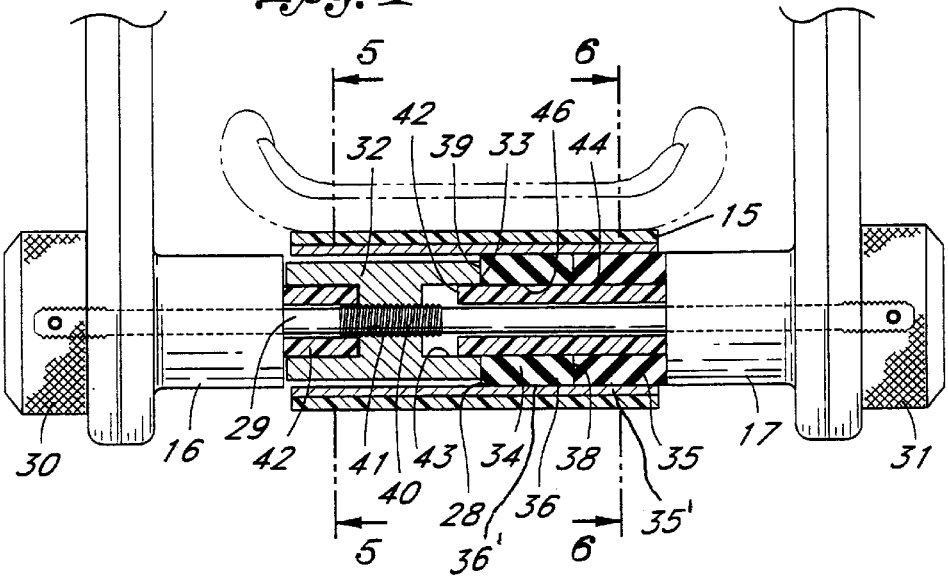
FIG. 4 a view analogous to FIG. 5 except that the sleeve portion thereof is shown in cross-sectional view.
Figure 5:
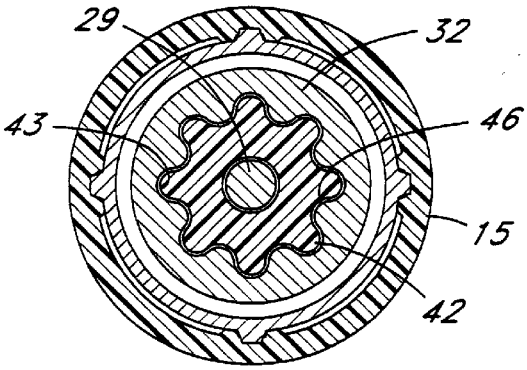
FIG. 5 is a cross-sectional view taken along line 5—5 of FIG. 4.
Figure 6:
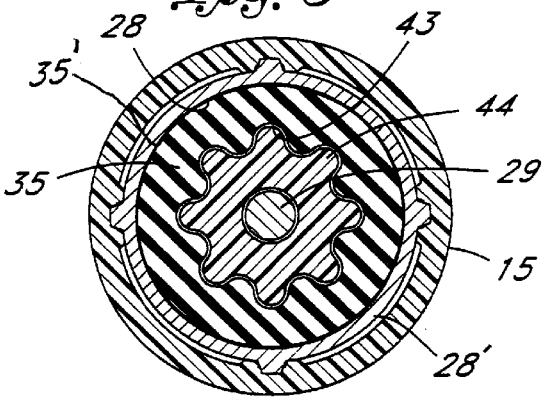
FIG. 6 is a cross-sectional view taken along line 6—6 of FIG. 4.

The upper arm support platform 11 and the hand driven assembly 12 are interconnected at a pivot hinge 27 and as shown best in FIG. 4. In FIG. 4, the pivot sleeve 15 is shown and has a cylindrical opening 28. While the opening is shown as cylindrical it could, of course, be slightly domed or slightly hourglassed and, thus, is referred to herein as a "generally cylindrically shaped opening" 28. This opening surrounds an axle pin 29 which is secured to knobs 30 and 31. The cylindrical opening 28 preferably includes an aluminum sleeve 28' spaced from pivot sleeve 15 and held by four tabs so that heat generated by friction is insulated from sleeve 15. The knobs may be turned to turn axle pin 29 in pivot collars 16 and 17 and within sleeve 15.

By turning either knob 30 or 31 the resistance force of friction to the movement of the upper arm support platform 11 and the hand driven assembly 12 is increased or decreased. This is carried out by the movement of a piston 32 which has a piston face 33. Piston face 33 abuts one of two elastomeric ring members 34 and 35. Although two elastomeric ring members 34 and 35 are shown, a single elastomeric ring could also perform this function. As the piston face presses against these ring members their outer surfaces 36 and 37 press against the cylindrical opening 28 in the aluminum sleeve 28' within pivot sleeve 15 and cause friction to movement of the outer surfaces 35' and 36' by elastomeric ring members 35 and 36 with respect to pivot sleeve 15. A ring expansion pressure is exerted against the end surfaces 38 and 39 of ring members 35 and 34 by the horizontal movement of piston 32. This horizontal movement is carried out by the turning of threaded sleeve 40 within a threaded opening 41 of piston 32. Piston 32 is secured against turning with respect to pivot end collar 16 and 17 by two gears 42 which comprises members with gear-shaped openings 43 formed in both ends of piston 32. Thus, piston 32 can move in or out in pivot sleeve 15 but cannot turn with respect to pivot end collars 16 and 17 and thus with respect to hand driven assembly 12. Elastomeric ring members 35 and 36 are similarly shaped so that they lock with gear 44 which interlocks with the inner surfaces 45 and 46 of ring members 35 and 34.

Figure 7:
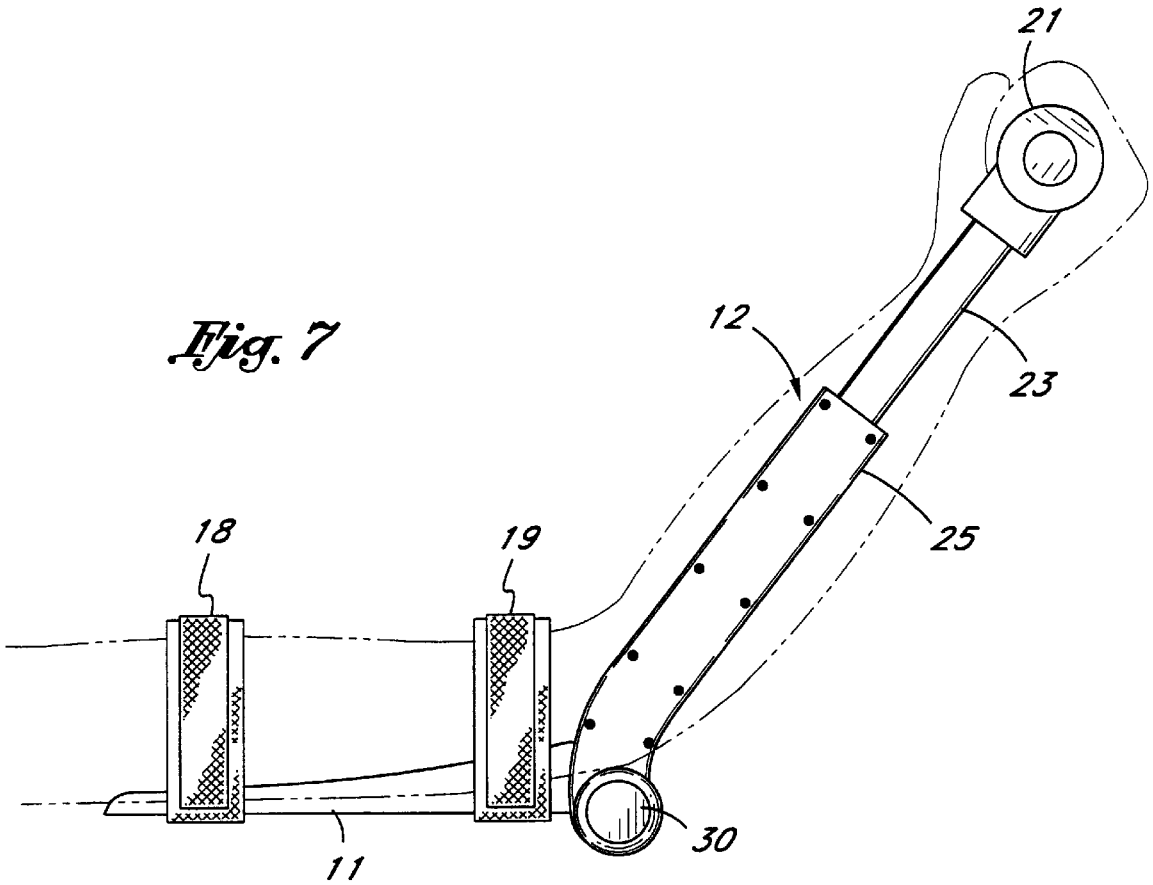
FIG. 7 is a side view of the arm exercising device of FIG. 1 showing a user's arm in phantom view.
Figure 8:
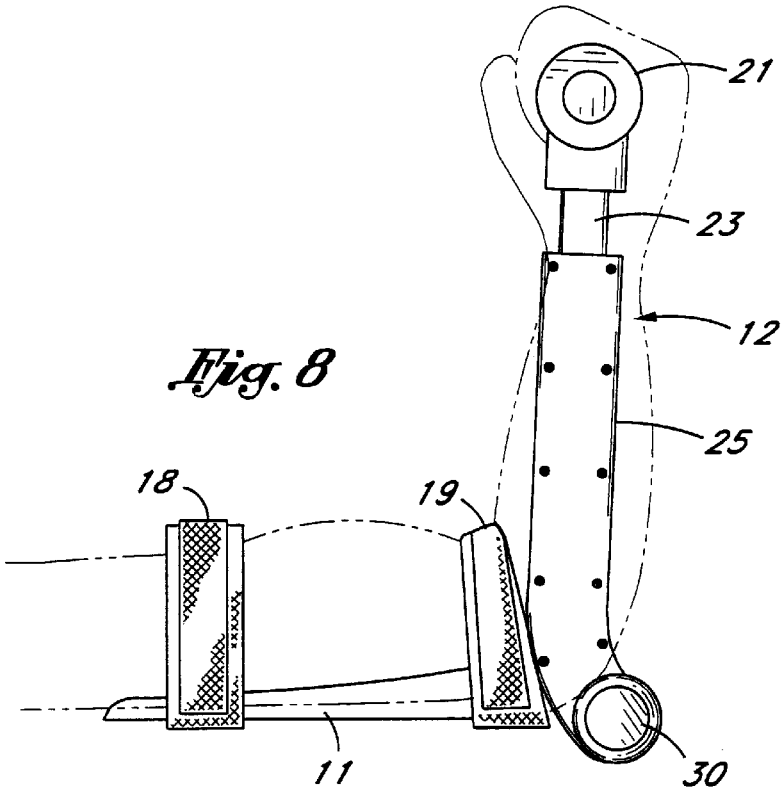
FIG. 8 is a side view analogous to FIG. 5 except that the user's arm is somewhat contracted.

In use, the user straps upper arm support platform 11 to his or her upper arm by securing straps 18 and 19 around the user's bicep and under the user's upper arm adjacent the user's tricep. The user's hand grasps handle 21 and knob 30 is turned to create the desired amount of friction. Of course, as the piston moves away from ring members 34 and 35, the friction force decreases. As shown by comparing FIGS. 7 and 8 the handle moves axially along the hand driven assembly 12 and it moves in and out along elliptical tube assemblies 25 and 26. This movement is essentially free and without substantial friction so that the exercise action is provided solely by the friction applied within sleeve 15.

Ring members 34 and 35 are preferably fabricated from a urethane elastomer because of its high resistance to abrasion. The remaining portions of the device may be fabricated from polyvinyl chloride, although the piston 32 is preferably made of a metal as, of course, is axle pin 29 and threaded collar 40.

Figure 9:
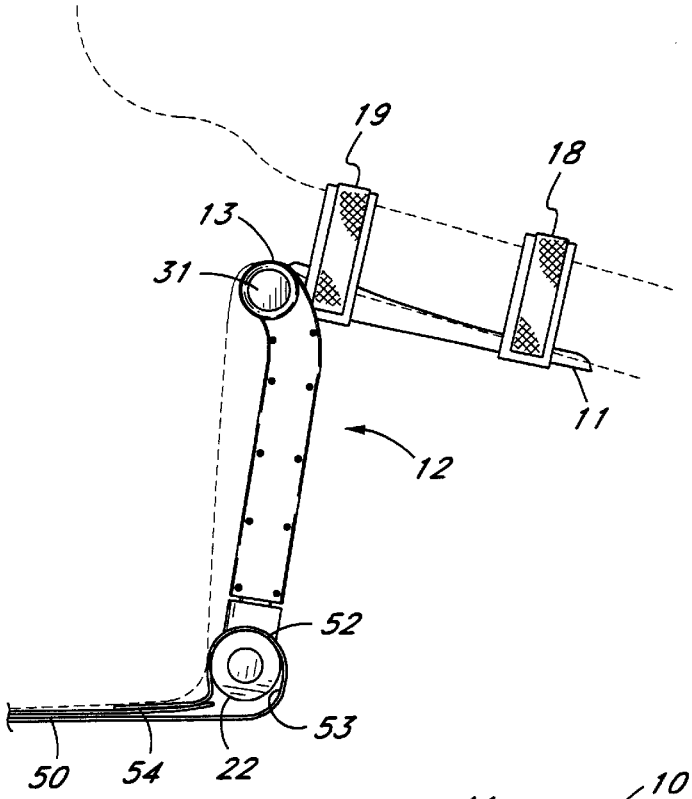
FIG. 9 is a side view of the arm exercising device of FIG. 1 configured to exercise a user's deltoid and lateral muscles showing a portion of a user in phantom view.
Figure 10:
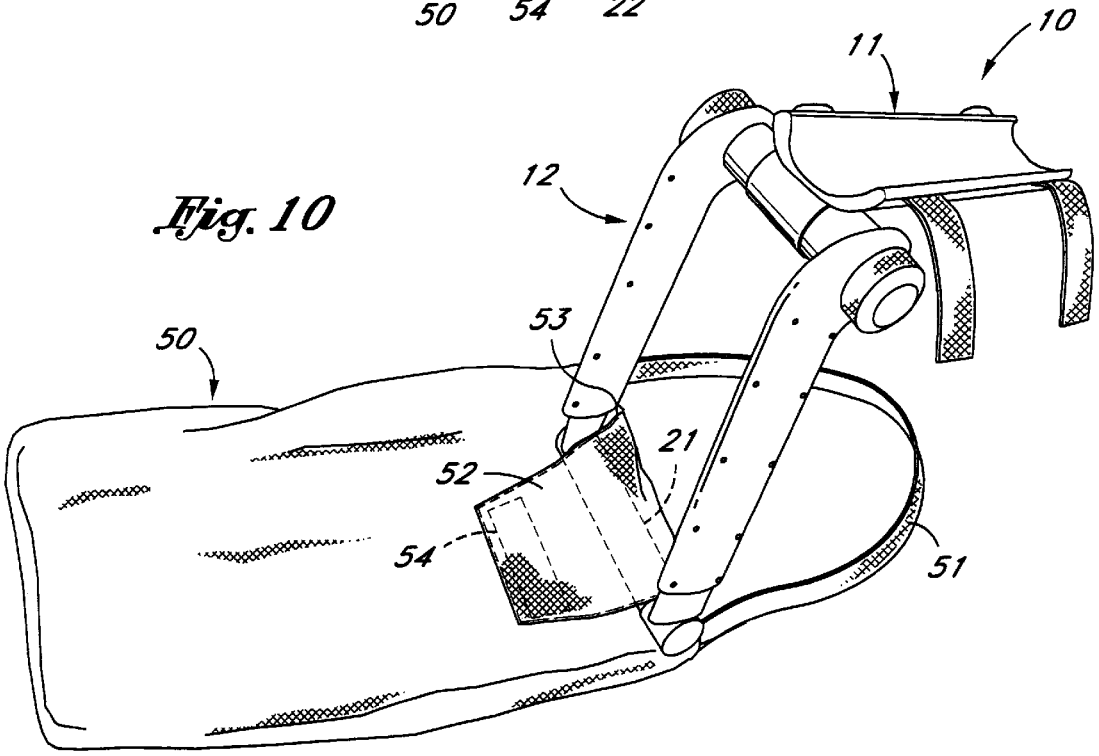
FIG. 10 is a perspective view of the arm exercising device of the present invention held by a carrying/handle-holding bag.

An important benefit of the exercising device of the present invention is that it can also be used to exercise the user's deltoid and lateral muscles as indicated in FIG. 9. A carrying bag 50 can be used to hold the device against a user's side. Bag 50 has a bag handle 51 and a cover 52. The cover 52 can be wrapped around the handle 21 and secured by Velcro 54, one-half of which is on the inner edge of cover 52 and the other half of which is on the outer surface of bag 50. Then the user sits on bag 50 with the loop 53 form in the cover 52 securing the handle 21 against the user's side. Then as the user moves his arm upwardly and downwardly, the user's deltoid muscle is exercised during an upward movement and the user's lateral muscles are exercised during a downward movement. Once again, knobs 30 or 31 may be turned to increase or decrease the friction. It is highly advantageous that both knobs turn since it would be very difficult for a user to turn a knob on the rear side as viewed in FIG. 9.

Thus, the exercising device of the present invention is highly compact, easy to use, relatively light weight and usable by men or women. It also is versatile in that it can exercise not only the user's biceps and triceps, but can be affixed in a different position to exercise a user's deltoid and lateral muscles.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An arm exercising device for strengthening a user's bicep and tricep muscles, said exercising device comprising:

an upper arm support platform attachable to a user's upper arm adjacent a user's tricep muscle under a user's upper arm, said upper arm support platform having a pivot end and a remote end and an arm support area therebetween;

means for holding said upper arm support platform against a user's upper arm;

a hand driven assembly having a platform-attaching end and a hand grasping end, said hand driven assembly being pivotally attached at a pivot hinge at its platform-attaching end to the pivot end of said upper arm support platform;

a handle attached to said hand driven assembly at said hand grasping end said handle being held to said hand driven assembly so that while the handle is moved toward and away from the remote end of the upper arm support platform by a user grasping, actively exerting force, and moving the handle by exertion of the user's bicep and tricep muscles whilst the upper arm support platform is attached to a user's upper arm during exercise, the handle will move in an axial direction along the hand driven assembly closer to and further away from the pivot end;

means for adjustably applying frictional resistance at said pivot hinge to absorb the force exerted by the user by the exertion of the user's bicep and tricep muscles during the pivoting back and the pivoting forth between the upper arm support platform and the hand driven assembly to actively exercise the user's bicep and tricep muscles and wherein said hand driven assembly comprises:

a pair of cylinder assemblies each cylinder assembly having a hinged end attached to said pivot hinge and a piston rod support end;

a pair of piston rods, each piston rod having a piston end slidably held in one of said pair of cylinder assemblies and extending out of the piston rod support end and each piston rod terminating in a handle end; and said handle is held between said handle end of each of said pair of piston rods and while the handle is moved toward and away from the remote end of the upper arm support platform by a user, the pair of piston rods slide in and out along each cylinder assembly.

2. The arm exercising device of claim 1 wherein each cylinder assembly has a pivot end collar which is adjacent each end of a pivot sleeve located at the pivot end of said upper arm support platform.

3. The arm exercising device of claim 2 wherein said hand driven assembly (12) includes a first interlocking member (44) positioned within said generally cylindrically shaped opening and wherein said elastomeric ring member (36) is shaped to interlock with said first interlocking member (44) so that said elastomeric ring member (36) is fixed with respect to said hand driven assembly (12) and turns with respect to said sleeve (28') as said hand driven assembly is pivoted.

4. The arm exercising device of claim 3 wherein said hand driven assembly (12) further includes a second interlocking member (42) and a piston (32) interlocked to said second interlocking member (42) so that it can not turn with respect to said hand driven assembly (12) and wherein said hand driven assembly (12) and said sleeve (28') are held together by an axle pin (29) which is turned by a handle (30) affixed to at least one end thereof and wherein said axle pin (29) has a threaded portion (40) which mates with a threaded portion (41) of said piston (32) and wherein said piston (32) has a piston face (33) abutting an end surface (39) of said elastomeric ring member (36) whereby when said handle (30) is turned with respect to said hand driven assembly (12), said piston (32) will move against or away from said end surface (39) of said elastomeric ring member (36) causing said elastomeric ring member (36) to expand or contract and to cause its outer surface (36') to rub with increasing or decreasing force against said sleeve (28) thus increasing or decreasing the friction between said upper arm support platform (11) and said hand driven assembly (12).

5. The arm exercising device of claim 1 wherein said means for adjustably applying friction comprises:

a sleeve held by one of said pivot end of said upper arm support platform and said platform attaching end of said hand driven assembly and a hinge pin held by the other of said pivot end of said upper arm support platform and said platform attaching end of said hand driven assembly, said sleeve having a generally cylindrically shaped opening therein which surrounds a middle portion of said hinge pin;

an elastomeric ring member held within said generally cylindrically shaped opening so that it can not turn with respect to said the other of said upper arm support platform and said hand driven assembly and said elastomeric ring member having an outer surface shaped to mate with said generally cylindrically shaped opening and said elastomeric ring member having two end surfaces; and means for adjustably increasing or decreasing pressure on said two end surfaces of said elastomeric ring member thereby causing said outer surface of said elastomeric ring member to press increasingly or decreasingly against said generally cylindrically shaped opening as the pressure exerted on said two end surfaces increases or decreases and to cause an adjustable amount of friction during a pivoting movement between said outer surface of said elastomeric ring member and said generally cylindrically shaped opening.

6. The arm exercising device of claim 5 wherein said sleeve is affixed to said upper arm support member.

7. An arm exercising device for exercising a user's biceps and triceps, said exercising device comprising:

an upper arm support platform having a pivot end and a remote end and said upper arm support platform including means for attaching the platform to a user's upper arm adjacent a user's tricep muscle and said upper arm support platform having a cylindrical sleeve at said pivot end thereof;

a hand driven assembly having a handle end supporting a handle and a platform attaching end, said handle being supported between two piston rods slidingly guided by two cylinder assemblies which in turn are pivotally secured to said cylindrical sleeve by an axle pin passing through said platform attaching end which axle pin passes through and pivotally supports said cylindrical sleeve; and an adjustable friction applying mechanism affixed over said axle pin within said cylindrical sleeve so that a user may exercise his or her biceps and triceps by affixing the upper arm support to an upper arm, grasping the handle and bending and unbending his or her arm.

8. A method of using the arm exercising device of claim 7 for exercising a user's deltoids and laterals comprising:

affixing said upper arm support platform to a user's upper arm; and affixing said hand driven assembly against the side of a user whereby when the user moves his or her arm outwardly, the user's deltoid muscle is exercised and when the user moves his or her arm inwardly, the user's lateral muscles are exercised.

* * * * *